US010662719B2

(12) United States Patent
Fossheim et al.

(10) Patent No.: US 10,662,719 B2
(45) Date of Patent: May 26, 2020

(54) TELESCOPIC DEPLOYMENT MAST

(71) Applicant: National Oilwell Varco, L.P., Houston, TX (US)

(72) Inventors: Norman W. Fossheim, Heritage Pointe (CA); Wei Chen, Calgary (CA); Brian T. Heidmiller, Calgary (CA)

(73) Assignee: National Oilwell Varco, L.P., Houston, TX (US)

( * ) Notice: Subject to any disclaimer, the term of this patent is extended or adjusted under 35 U.S.C. 154(b) by 245 days.

(21) Appl. No.: 15/882,654

(22) Filed: Jan. 29, 2018

(65) Prior Publication Data

US 2018/0216413 A1 Aug. 2, 2018

Related U.S. Application Data

(60) Provisional application No. 62/452,126, filed on Jan. 30, 2017.

(51) Int. Cl.

| | |
|---|---|
| ***E21B 15/00*** | (2006.01) |
| ***E21B 19/22*** | (2006.01) |
| ***E21B 7/02*** | (2006.01) |

(52) U.S. Cl.
CPC ..... *E21B 15/00* (2013.01); *E21B 7/023* (2013.01); *E21B 19/22* (2013.01)

(58) Field of Classification Search
CPC ..... E21B 15/00; E21B 19/22; E21B 7/023
See application file for complete search history.

(56) References Cited

U.S. PATENT DOCUMENTS

| | | | | |
|---|---|---|---|---|
| 3,207,044 | A | 9/1965 | Hall | |
| 3,802,136 | A | 4/1974 | Eiler | |
| 4,337,601 | A | 7/1982 | Vaerk et al. | |
| 5,628,416 | A | 5/1997 | Frommelt et al. | |
| 5,937,943 | A * | 8/1999 | Butler | E21B 19/22 166/77.2 |
| 6,264,128 | B1 * | 7/2001 | Shampine | B65H 54/2827 242/397.3 |
| 6,273,188 | B1 * | 8/2001 | McCafferty | E21B 19/22 166/77.2 |
| 7,077,209 | B2 | 7/2006 | McCulloch et al. | |
| 7,111,689 | B2 | 9/2006 | Wise et al. | |
| 8,561,693 | B2 * | 10/2013 | Mydur | E21B 19/084 166/250.01 |

(Continued)

OTHER PUBLICATIONS

PCT/US2018/015747 International Search Report and Written Opinion dated Apr. 13, 2018 (15 p.).

*Primary Examiner* — Daniel P Stephenson
(74) *Attorney, Agent, or Firm* — Conley Rose, P.C.

(57) ABSTRACT

A lifting mast assembly includes telescoping load bearing arms pivotably coupled to a support base and configured to pivot in unison. Each telescoping arm includes a first arm section and an aligned second arm section. The first arm sections are configured to telescope in unison with one another. Likewise, the second arm sections are configured to telescope in unison with one another. Each first arm section may telescope independently of the second arm section with which it is coaxially aligned. A first support member is coupled to each of the first arm sections, and a second support member is coupled to each of the second arm sections. Different loads can be supported on the first and second support members simultaneously.

16 Claims, 7 Drawing Sheets

(56) References Cited

U.S. PATENT DOCUMENTS

| | | | | |
|---|---|---|---|---|
| 9,027,287 | B2 * | 5/2015 | Trevithick | E21B 15/00 52/112 |
| 9,091,128 | B1 * | 7/2015 | Orgeron | E21B 19/14 |
| 9,316,067 | B1 * | 4/2016 | Lu | E21B 19/08 |
| 10,138,691 | B2 * | 11/2018 | Kos | E21B 19/155 |
| 2013/0341001 | A1 | 12/2013 | Kos et al. | |
| 2013/0341013 | A1 * | 12/2013 | Flusche | E21B 7/02 166/250.15 |
| 2014/0158657 | A1 | 6/2014 | Knecht et al. | |
| 2018/0216413 | A1 * | 8/2018 | Fossheim | E21B 15/00 |

* cited by examiner

TELESCOPIC DEPLOYMENT MAST

STATEMENT REGARDING FEDERALLY SPONSORED RESEARCH OR DEVELOPMENT

This application claims benefit of U.S. provisional patent application Ser. No. 62/452,126 filed Jan. 30, 2017, and entitled "Telescopic Deployment Mast," which is hereby incorporated herein by reference in its entirety for all purposes.

CROSS-REFERENCE TO RELATED APPLICATIONS

Not applicable.

BACKGROUND

Field of the Disclosure

This disclosure relates generally to truck or trailer mounted lifting masts. More particularly, it relates to masts having telescoping arms. Still more particularly, this disclosure relates to lifting-masts suited for hoisting and manipulating multiple objects simultaneously.

Background to the Disclosure

Coiled tubing injectors are used to run continuous pipe into and out of wellbores. Continuous pipe is referred to as coiled tubing because it is stored on a large reel. Coiled tubing can be used for drilling operations, and is likewise well-suited for servicing existing wells. It can be inserted into and removed from the wellbore without having to first erect a complex drilling rig or other structure at the well site. In a conventional operation using a conventional piece of lifting equipment, one oilfield apparatus (e.g. a downhole tube, a tubular member, a coiled tubing injector, or other) is hoisted and maneuvered at-a-time. The first oilfield apparatus must be set down and disconnected before the next oilfield apparatus can be hoisted and moved into place.

BRIEF SUMMARY OF THE DISCLOSURE

These and other needs in the art are addressed by a method for hoisting and positioning oilfield apparatus in alignment with a wellbore. In one embodiment, the method includes positioning a moveable support base at a first location at a given distance from the wellbore. A first oilfield apparatus is coupled to a mast having at least two telescoping load bearing arms that are pivotably coupled to the support base, each of the arms comprising a first arm section and a second arm section that is coaxially aligned with the first arm section. The first arm section is configured to telescope independently of the second arm section with which it is coaxially aligned. The first arm section of the first arm is configured to telescope in unison with the first arm section of the second arm, and the second arm section of the first arm is configured to telescope in unison with the second arm section of the second arm. The method further includes lifting the first oilfield apparatus through an action of extending the first section of the at least first and second telescoping arms, and pivoting the at least two telescoping arms to a first position in which the first oilfield apparatus is positioned over the wellbore.

In another embodiment, the method includes positioning a moveable support base a given distance from the wellbore, and hoisting a first oilfield apparatus from the support base using a mast having at least two telescoping load bearing arms that are pivotably coupled to the support base. In this embodiment, each of the arms comprises a first arm section and a second arm section that is coaxially aligned with the first arm section, wherein each first arm section is configured to telescope independently of the second arm section with which it is coaxially aligned. The first arm section of the first arm is configured to telescope in unison with the first arm section of the second arm, and the second arm section of the first arm is configured to telescope in unison with the second arm section of the second arm. Hoisting is accomplished through an action of extending at least the first sections of the first and second telescoping arms. Further, the method includes pivoting the at least two telescoping arms to a first position while supporting the first oilfield apparatus.

In another embodiment, an apparatus for hoisting oilfield apparatus to a position aligned with a wellbore includes a support base configured for movement along the earth's surface and a mast assembly comprising at least two telescoping load bearing arms pivotably coupled to the support base and configured to pivot in unison with each other relative to the support base. The support base can be wheeled, tracked, skid-mounted, or rail-mounted as examples. Each of the two telescoping arms comprises a first arm section and a second arm section that is coaxially aligned with the first arm section. The first arm section of the first arm is configured to telescope selectively to a longer or a shorter length in unison with the first arm section of the second arm, and the second arm section of the first arm is configured to telescope selectively to a longer or a shorter length in unison with the second arm section of the second arm. Each first arm section is configured to telescope independently of the second arm section with which it is coaxially aligned. Moreover, the apparatus includes a first support member coupled to the first arm sections of the first and second telescoping arm and includes a second support member coupled to the second arm sections of the first and second telescoping arm.

Thus, embodiments described herein include a combination of features and characteristics intended to address various shortcomings associated with certain prior devices, systems, and methods. The various features and characteristics described above, as well as others, will be readily apparent to those of ordinary skill in the art upon reading the following detailed description, and by referring to the accompanying drawings.

BRIEF DESCRIPTION OF THE DRAWINGS

For a detailed description of the disclosed exemplary embodiments, reference will now be made to the accompanying drawings, wherein.

NOTATION AND NOMENCLATURE

Figure 1:
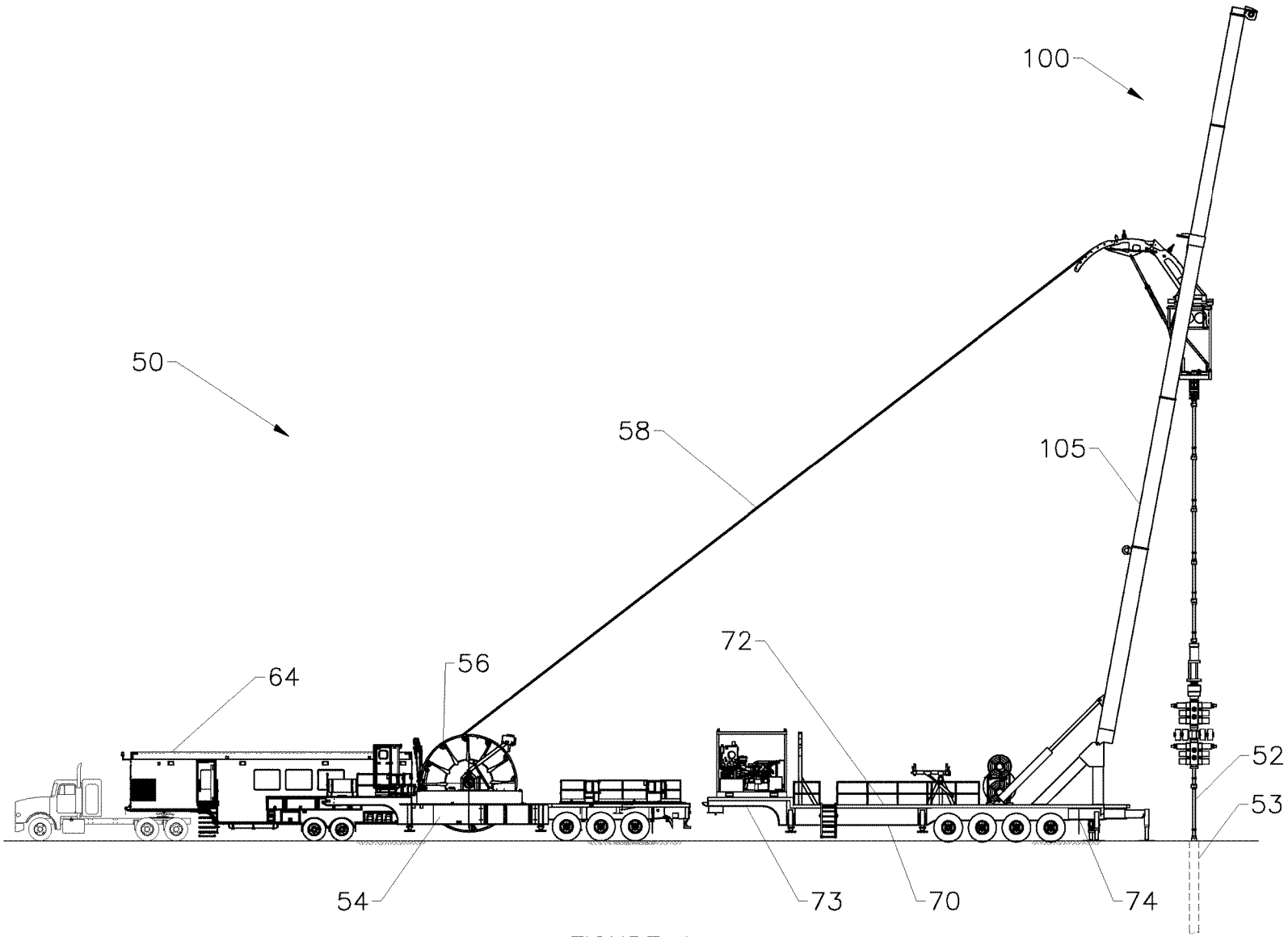
FIG. 1 shows an elevation view of an embodiment of a well operations system that includes mast trailer with a twin telescoping mast in accordance with principles described herein.

The following description is exemplary of certain embodiments of the disclosure. One of ordinary skill in the art will understand that the following description has broad application, and the discussion of any embodiment is meant to be exemplary of that embodiment, and is not intended to suggest in any way that the scope of the disclosure, including the claims, is limited to that embodiment.

The figures are not necessarily drawn to-scale. Certain features and components disclosed herein may be shown exaggerated in scale or in somewhat schematic form, and some details of conventional elements may not be shown in the interest of clarity and conciseness. In some of the figures, in order to improve clarity and conciseness, one or more components or aspects of a component may be omitted or may not have reference numerals identifying the features or components. In addition, within the specification, including the drawings, like or identical reference numerals may be used to identify common or similar elements.

As used herein, including in the claims, the terms "including" and "comprising," as well as derivations of these, are used in an open-ended fashion, and thus are to be interpreted to mean "including, but not limited to . . . ." Also, the term "couple" or "couples" means either an indirect or direct connection. Thus, if a first component couples or is coupled to a second component, the connection between the components may be through a direct engagement of the two components, or through an indirect connection that is accomplished via other intermediate components, devices and/or connections. The recitation "based on" means "based at least in part on." Therefore, if X is based on Y, then X may be based on Y and on any number of other factors. The word "or" is used in an inclusive manner. For example, "A or B" means any of the following: "A" alone, "B" alone, or both "A" and "B."

In addition, the terms "axial" and "axially" generally mean along a given axis, while the terms "radial" and "radially" generally mean perpendicular to the axis. For instance, an axial distance refers to a distance measured along or parallel to a given axis, and a radial distance means a distance measured perpendicular to the axis. Furthermore, any reference to a relative direction or relative position is made for purpose of clarity, with examples including "top," "bottom," "up," "upward," "down," "lower," "clockwise," "left," "leftward," "right," "right-hand," "down", and "lower." For example, a relative direction or a relative position of an object or feature may pertain to the orientation as shown in a figure or as described. If the object or feature were viewed from another orientation or were implemented in another orientation, it may be appropriate to describe the direction or position using an alternate term.

DETAILED DESCRIPTION OF THE DISCLOSED EXEMPLARY EMBODIMENTS

U.S. Pat. No. 7,077,209 entitled "Mast for Handling a Coiled Tubing Injector" discloses a single telescoping mast for lifting and suspending a load such as a coiled tubing injector or, separately, a blowout preventer (BOP) over a wellhead. The single telescoping mast includes a pair of arms that support and raise a single support member from which the selected load is suspended. U.S. Pat. No. 7,077,209 is hereby incorporated herein by reference in its entirety for all purposes.

In FIG. 1 of the present disclosure, a well operations system 50 is positioned and prepared for working at a wellhead 52 over a wellbore 53 associated with hydrocarbon discovery or production. System 50 includes a coiled tubing reel trailer 54, a control trailer 64, and a mast trailer 70. Reel trailer 54 holds a coiled tubing reel 56 that feeds coiled tubing 58 to mast trailer 70. Control trailer 64 includes equipment and office space for governing the operations of trailers 54, 70.

Figure 2:
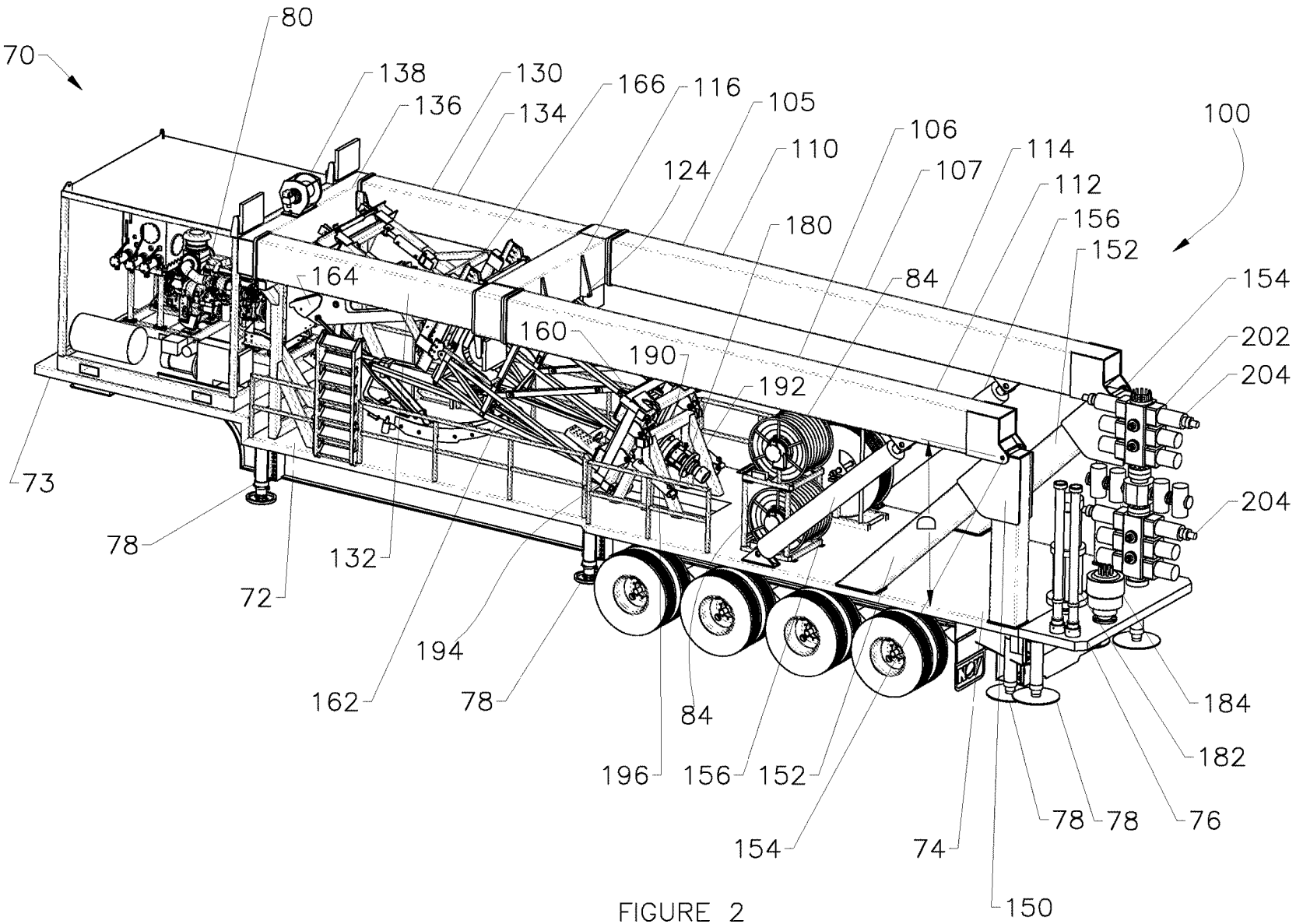
FIG. 2 shows a perspective side view of the mast trailer with the twin telescoping mast of FIG. 1 in a transportation configuration.

Referring now to FIG. 2, an embodiment of mast trailer 70 is shown in a transportation configuration. Trailer 70 includes a bed or deck 72 extending from a trailer front end 73 to a trailer rear end 74, an equipment platform 76 extending from deck 72 at rear end 74, and multiple stabilizers 78. Mast trailer 70 further includes a hydraulic power supply 80 at front end 73, hydraulic hose reels 84, and a mast assembly 100 mounted to deck 72 adjacent rear end 74. Some stabilizers 78 include jacks with base-platforms to rest against the ground. Some stabilizers 78 include telescopic legs that extend down to the ground. Some of the stabilizers 78 include out-riggers to position the associated jacks and bases horizontally away from the trailer deck 72 for greater stability. A coiled tubing injector 160 is supported on trailer 70 by an injector lift mechanism 190, which may also be called lift 190. Pressure control equipment 202 (PCE) is shown mounted on platform 76 for transportation to a working site where it may be installed on wellhead 52. Equipment 202 includes a stack of multiple blowout preventers (BOP) 204, which, in this example, are ram-type BOPs. Each of equipment 202 and BOP 204 is an example of an oilfield apparatus suitable for hoisting and maneuvering using mast assembly 100.

Mast assembly 100 is configured to deploy or to hold an oilfield apparatus in an elevated position, such as an elevated position alignment with wellbore 53 (FIG. 1). Moreover, assembly 100 is configured to deploy or to hold multiple pieces of oilfield equipment (i.e. oilfield apparatuses) during well operations or testing, with one or more of the multiple pieces of equipment being suspended separately, from different elevations on assembly 100. Mast assembly 100 includes a twin telescoping mast 105 and a mounting structure 150 that couples mast 105 to deck 72. Trailer 70 and deck 72 are configured as a wheeled support base for mast assembly 100, and mounting structure 150 is configured as a support base for mast 105. In FIG. 2, mast 105 lies horizontal, parallel to trailer deck 72, in a position suitable for storage or transportation on the highway. Twin mast 105 includes at least two telescoping load bearing arms 106, 107 spaced-apart horizontally and pivotally coupled to mounting structure 150 and deck 72. Arms 106, 107 are parallel, extending along a longitudinal axis 108, 109, respectively. Each of the arms 106, 107 includes two aligned, telescoping arm sections. Specifically, left arm 106 includes a left arm lower section 112 having a lower end 121 and an upper end 122 and includes a left arm upper section 132 configured to extend beyond the upper end 122 of section 112. Right arm 106 includes a right arm lower section 114 having a lower end 121 and an upper end 122 and includes a right arm upper section 134 configured to extend beyond an upper end 122 of section 114. Each lower section 112, 114 is configured to telescope selectively to longer or shorter lengths within a designed range, independently of the upper section 132, 134 with which it is coaxially aligned. In an example, designed range of length for the lower sections 112, 114 is from 33 feet to 81.2 feet, measured from hinge pins 154. Some embodiments have a range than extends to a shorter or to a longer length. Likewise, each upper section 132, 134 is configured to telescope selectively to longer or shorter length within a designed range, independently of the corresponding lower section 112, 114. In an example, designed range of length for the upper sections 132, 134 is from 3.67 feet to 36 feet, measured from lower support member 116. Some embodiments have a range than extends to a shorter or to a longer length. The left arm lower section 112 is configured to telescope in unison with the right arm lower section 114, and the left arm upper section 132 is configured to telescope in unison with right arm upper section 134. A lower support member 116 is coupled between the lowermost section 112, 114 of each of the arms 106, 107 defining a lower mast 110. An upper support member 136 is coupled between the upper-most section 132, 134 of each of the arms 106, 107 defining an upper mast 130. Thus, twin telescoping mast 105 includes two, telescoping masts 110, 130. As described in more detail below, masts 110, 130 may be actuated so as to extend independently of own another. In an example, the minimum distance between lower support member 116 and upper support member 136 is 2.67 feet when the upper mast 130 is fully retracted, but other minimum distances are possible. For example, in some embodiments, member 136 rests against or adjacent member 116 when fully retracted. In the example, the ratio of the length of the lower mast 110 versus the length of the upper mast 130 is 9:1 when both are fully retracted and 2.3:1 when both are fully extended.

Lower mast 110 is pivotally coupled directly to mounting structure 150, and upper mast 130 is coupled to mounting structure 150 through the lower mast 110. Upper mast 130 is configured to telescopically extend away from lower mast 110 and the mounting structure 150. Upper mast 130 and upper support member 136 are configured to extend to greater a distance or a greater height from grade and from deck 72 than lower mast 110 and lower support member 116. For any angular location of mast 105, upper support member 136 is located more distal the mounting structure 150 than is the lower support member 116. Either support member 116, 136 may also be called a cross-member or a crown. In the FIG. 1, support members 116, 136 are elongate beams or other structural members that extend generally perpendicular to the telescoping arms 106, 107. In this embodiment, members 116, 136 are horizontal.

Continuing to reference FIG. 2, mounting structure 150 includes two V-shaped legs 152 spaced-apart horizontally and mounted adjacent the rear end 74 of trailer deck 72. Each leg 152 includes a vertex vertically spaced above deck 72. Hinge pins 154 extends through the vertex and through the lower ends 121 of a lower sections 112, 114 of the lower mast 110 at a distance D above deck 72, each pin 154 thereby forming a rotational, hinge coupling. Mounting structure 150 further includes two hydraulic cylinders 156. Each hydraulic cylinder 156 is coupled to one of the lower sections 112, 114 at a location spaced apart from the corresponding hinge pin 154, and is coupled to deck 72 at a location more distal the rear end 74 than is the corresponding leg 152. With this arrangement, mounting structure 150 is configured to pivot the twin mast 105 about hinge pins 154 in order to raise and lower the mast 105 relative to deck 72 and to adjust the position of mast 105 and the equipment that it may hold relative to a wellbore or other desired position for placement.

Figure 3:
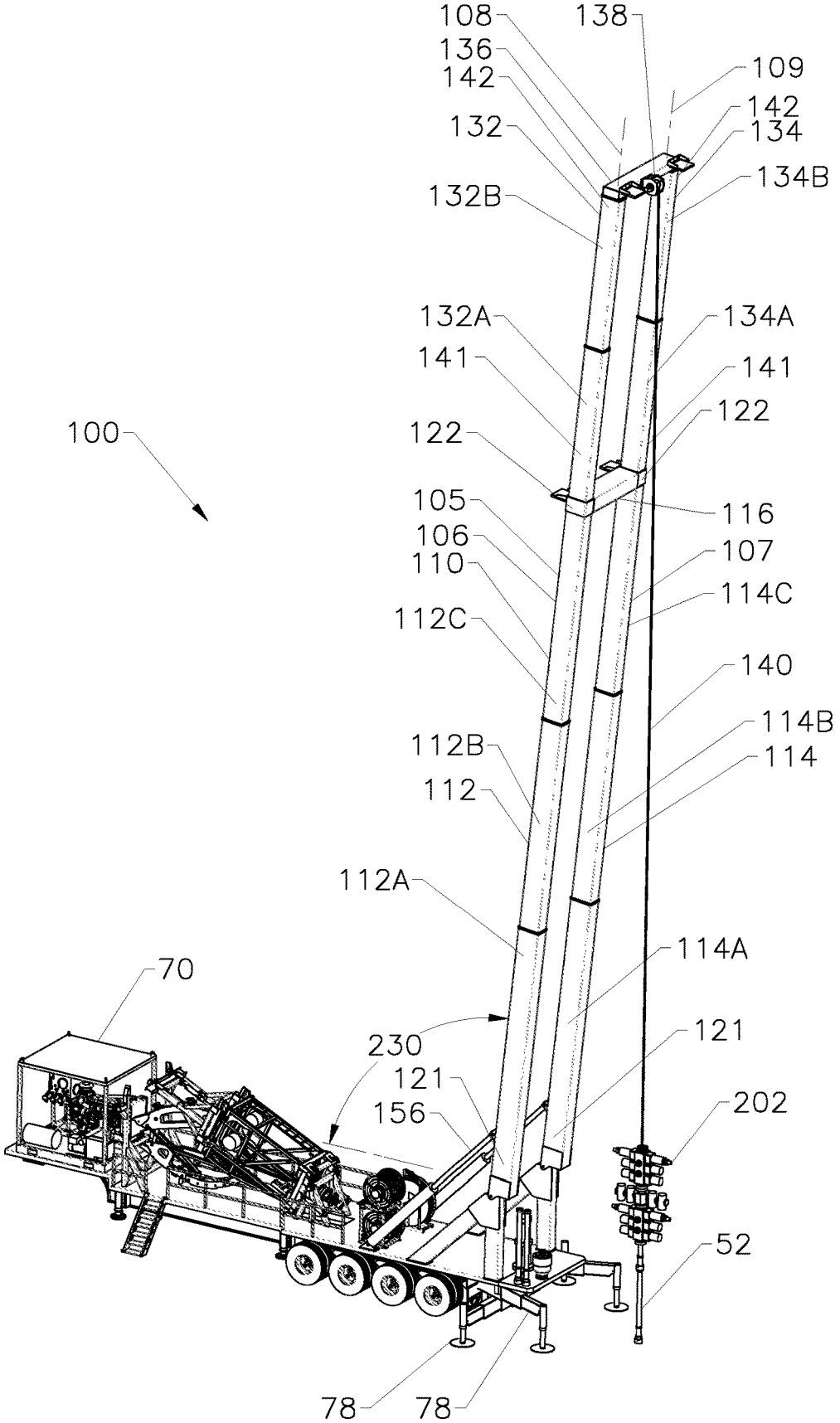
FIG. 3 shows perspective side view of the mast trailer of FIG. 2 with the twin telescoping mast extended and elevated.

Referring now to FIG. 3, twin telescoping mast 105 is shown in a position rotated about hinge pin 154 and extending upward from trailer 70. Due to the angle and height selected for mast 105, both support members 116, 136 are positioned over the ground beyond the rear end 74 of trailer 70. Lower and upper masts 110, 130 are shown extended and reaching upward. The extended configuration of the lower mast 110 reveals that the lower section 112, 114 of each arm 106, 107 includes multiple, coaxially-aligned telescoping segments. In this example, left arm lower section 112 includes three telescoping arm segments 112A,B,C configured as a group to extend to longer lengths and to retract to shorter lengths along the longitudinal axis 108. Likewise, right arm lower section 114 includes three telescoping arm segments 114A,B,C configured as a group to extend to longer lengths and to retract to shorter lengths along the longitudinal axis 109. Arm segments 112A, 114A are the lowest and outermost segments, and arm segments 112C, 114C are the innermost segments and extend the highest of the segments 112A,B,C and 114A,B,C, respectively. In an example, each arm segment 112A,B,C and 114A,B,C is approximately 29.5 feet long. Lower support member 116 extends horizontally between and is connected to arm segments 112C, 114C at upper ends 122. As lower mast 110 extends outward at the angle shown, the lower support member 116 is raised to a greater height from the ground. Coiled tubing injector or another oilfield apparatus to be held over a wellhead may be coupled to the support member 116 when the mast 110 is in a retracted position, and the equipment may then be raised higher by extending or telescoping the mast assembly.

Arm segments 112A,B,C are interconnected by a lifting mechanism configured to cause sections 112A,B,C to telescope (that is to say: to extend or to retract) along axis 108. Likewise, arm segments 114A,B,C are also interconnected by another lifting mechanism configured to cause sections 114A,B,C to telescope along axis 109. In the example of FIG. 3, the lifting mechanisms are embedded within lower sections 112, 114. In some embodiments, the one or both of these lifting mechanism includes the motor-driven screw and lifting nut combination that is disclosed by U.S. Pat. No. 7,077,209. However, other lifting mechanisms, such as a hydraulic cylinder or a motor driven chain, cable, or jack screw, could be used to telescope the lower sections 112, 114. In various embodiments, a portion or all of the lifting mechanism is located outside the lower sections 112, 114. In some embodiments, a single lifting mechanism may be configured to actuate both lower sections 112, 114. An example of a telescoping mast or arm driven by a hydraulic cylinder lifting mechanism that is compatible with various embodiments of the present disclosure is presented in U.S. Pat. No. 5,628,416, in particular, see FIGS. 1-5 and accompanying text. U.S. Pat. No. 5,628,416 is incorporated herein by reference in its entirety for all purposes.

Also in FIG. 3, extension of the upper mast 130 reveals that each upper section 132, 134 includes multiple telescoping segments. In this example, upper sections 132, 134 each include two telescoping segments or arm segments 132A,B and 134A,B, respectively, configured to extend and to retract along axis 108, 109, respectively, each from a lower end 141 to an upper end 142. The lowest and outermost arm segments 132A, 134A are slidingly coupled to lower mast 110 and, at least in this example, are configured to telescope from and into the lower sections 112, 114. In an example, each arm segment 132A,B and 134A,B is approximately 29.5 feet long. Upper support member 136 extends generally perpendicularly to and is connected between the upper most arm segments 132B, 134B at upper ends 142. A hoist, which is in this example is a winch 138 that controls a wire rope or cable 140, is attached to support member 136. As lower mast 130 extends outward to the angle shown in FIG. 3, the upper support member 136 is raised to a greater height from the ground. A coiled tubing injector, pressure control equipment 202, or another oilfield apparatus to be held over a wellhead may be coupled to upper support member 136 and may then be raised higher by rotating or extending the telescoping mast assembly outward or by the lifting action of winch 138, or by a combination of these actions.

Arm segments 132A,B are interconnected by a lifting mechanism, and 134A,B are interconnected by a lifting mechanism. These lifting mechanisms are configured to telescope upper sections 132, 134 simultaneously along axes 108, 109, respectively. The lifting mechanisms of upper sections 132, 134 are similar or identical to any of the lifting mechanisms described for various embodiments of lower sections 112, 114, above. In the example of FIG. 3, the lifting mechanisms of arm segments 132A,B; 134A,B are embedded within upper sections 132, 134. Mast assembly 100 is configured such that the pair of upper sections 132, 134 may be linearly telescoped in or out while the pair of lower sections 112, 114 remains static, at a fixed length. Similarly, the pair of lower sections 112, 114 may be linearly telescoped in or out while the pair of upper sections 132, 134 remains at a fixed length. Optionally, either pair of arms (the upper or lower pair), may be extended or retracted while the other pair of arms moves in the same linear direction or in an opposite direction. In other words, the lower mast 110 and the upper mast 130 are configured for independent control in regard to linear, telescopic motion of their own lifting mechanisms. Of course, the selected length of lower mast 110 influences the minimum and the maximum distances that may be achieved between mounting structure 150 and upper support member 136 of the upper mast 130, which determines the minimum and the maximum heights that upper support member 136 may achieve for a selected angle of masts 110, 130.

Figure 4:
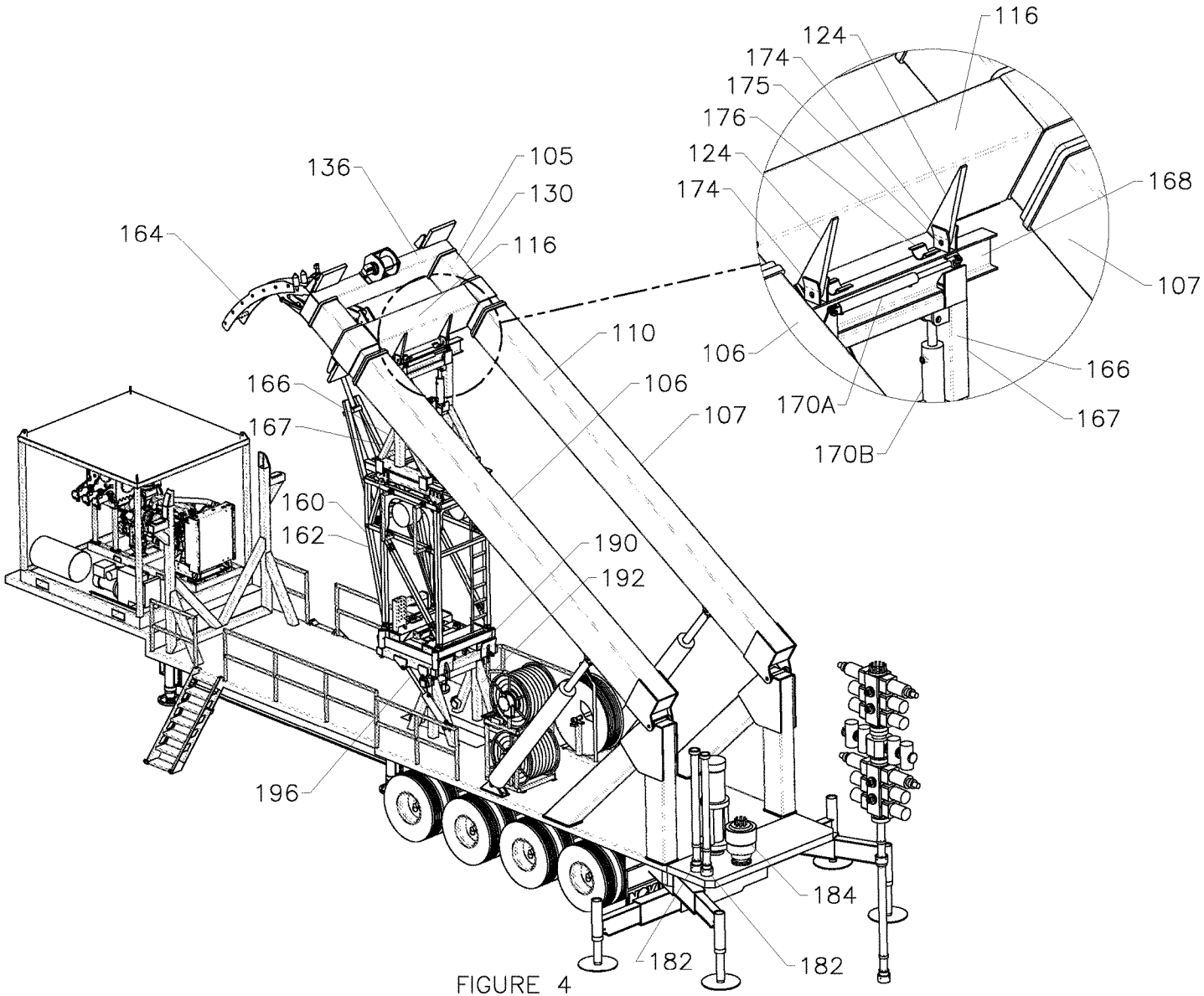
FIG. 4 shows a perspective side view of the mast trailer of FIG. 2 with the twin telescoping mast raised from the trailer's deck in order to couple to a coiled tubing injector.

Referring now to FIG. 4, coiled tubing injector 160 is an example of an oilfield apparatus that can be lifted, supported, and maneuvered by twin telescoping mast 105. In FIG. 4, injector 160 includes a frame 162, a goose-neck support assembly 164 coupled at the top of frame 162, and—better shown in FIG. 2—a stripper mechanism 180 coupled to and extending below the bottom of frame 162. Stripper 180 includes packing elements configured to allow coiled tubing 58 to be inserted into or removed from a wellhead and wellbore while maintaining, i.e. sealing, the pressure that is in the wellhead. Referring still to FIG. 4, injector 160 additionally includes a mounting assembly 166 coupled at the top of frame 162. Goose-neck 164 is configured to support coiled tubing as it is fed to injector 160 from a reel on which it is wound. Assembly 166 includes a mounting frame 167, a movable beam 168 coupled to frame 166 distal frame 162, one or more hydraulic cylinders 170 coupled between beam 168 frame 166 or frame 162, and multiple attachment members or brackets 174 extending from beam 168 and laterally spaced-apart. As shown in the enlarged portion of FIG. 4, in this example, two pair of brackets 174 are included, and each pair of brackets 174 is configured to align with a bracket or mounting lug 124 that extends from the bottom of lower support member 116. Brackets 174 and lugs 124 are connections that include through holes 175 configured to receive a pin in order to create a pair of rotational couplings that interconnect injector 160 and lower support member 116 to allow injector 160 to tilt to any of multiple positions between the two arms 112, 114. As lower mast 110 rotates about hinge pins 154. Two rounded brackets 176 on beam 168, one adjacent each bracket 174, are configured to receive a pin or a pin actuator to move a pin into and out of holes 175. To adjust the position of beam 168 relative to a mounting lugs 124 in order to align the holes 175, a first hydraulic cylinder 170A is arranged to move beam 168 laterally, and a second hydraulic cylinder 170B is arranged to move beam 168 away from and toward frame 162, which typically corresponds to moving beam 168 up or down. Thus, injector 160 includes an adjustable mounting frame 160 configured to compensate for misalignment between the trailer mounted position of injector 160 and position of the mounting lugs 124 on lower mast 110 during the process of coupling the injector 160 to mast 110. Also associated with injector 160, multiple tubular members of a lubricator 182 and an annular BOP 184 are held on platform 76 at the rear of trailer 70 in the exemplary embodiment shown in FIG. 2.

Continuing to reference FIG. 2, injector lift mechanism 190 mounts injector 160 to trailer deck 72 in a configuration suited for storage and transportation, and, as shown in FIG. 4, mechanism 190 is configured to rotate injector 160, lifting it to a vertical position or generally vertical position for coupling it to mast 110. Lift mechanism 190 includes legs 192 rigidly coupled on deck 72, a platform 194 rotationally coupled adjacent the top of legs 192 offset from deck 72, and one or more hydraulic cylinder 196 coupled between platform 194 and legs 192 to rotate platform 194 and injector 160 relative to deck 72. Laterally on deck 72, lift 190 is substantially disposed between arms 106, 107 of mast 105. Longitudinally on deck 72, legs 192 of lift 190 are located a distance from hinge pins 154 that is less than the distance between the hinge pins to the lower support member 116 when the arms 106, 107 are in disposed the position shown in FIG. 2. The bottom of injector frame 162 rests adjacent and is coupled to platform 194 with stripper 180 extending through or beyond platform 194 without interfering with deck 72. Hydraulic cylinder 196 is configured to influence the elevation and the front-to-rear position of injector 160 and movable beam 168 in order to coupled them to support member 116 of mast 110, such as shown in FIG. 4, and to stow injector 160 for transportation, as shown in FIG. 2. In the transportation configuration, platform 194 and the attached injector 160 are tilted toward the front end 73 of trailer 70, and approximately half of goose-neck support assembly 164 is folded underneath itself.

An Example of Using the Twin Telescoping Masts 110, 130 Sequentially

Mast assembly 100 and the included twin telescoping mast 105 on trailer 70 are operable as described in the following example. Trailer 70 arrives at a well site in the configuration of FIG. 2 and is positioned at a short distance from a wellbore or wellhead. As shown in FIG. 3, the trailer stabilizers 78 are deployed. The twin telescoping mast 105 is raised to a vertical or nearly vertical position. FIG. 3 shows lower mast 110 and the upper mast 130 of mast 105 fully extended; however, the lower mast 110 or the upper mast 130 may be partially or fully extended during this operation. The extension processes for the lower and upper masts 110, 130 are controlled independently to raise support members 116, 136 to the positions shown in FIG. 3. As shown in FIG. 3, winch 138 on upper support member 136 of mast 130 is used to lift the equipment 202 from trailer 70 and to place it on well head 52. To accomplish this task, mast 105 is rotated beyond the vertical position in order to align equipment 202 over wellhead 52. As compared to the horizontal position of mast 105 in FIG. 2, mast 105 in FIG. 3 is at an angle 230 of 95 degrees, which is 5 degrees beyond the vertical position and 5 degrees with respect to the vertical axis of wellbore 53 at the surface of the earth (it being understood that the axis of wellbore 53 may change direction below grade). If needed, mast 105 may be extended or retracted to achieve this alignment. In various instances, angle 230 is between 90 and 100 degrees while performing various operations over a wellbore. This range of angular positions corresponds to an angle from 0 to 10 degrees beyond the vertical position and, equally, 0 to 10 degrees with respect to the vertical axis of wellbore 53 at the surface of the earth. In some embodiments based on the teachings herein, angle 230 of mast 105 may reach beyond 100 degrees. In some instances when lifting equipment from trailer deck 72, angle 230 is between zero and 90 degrees.

Referring now to FIG. 4, lower mast 110 is fully retracted and the twin mast 105 is rotated forward, bringing the lower support member 116 to a location above the middle region of deck 72 where lift mechanism 190 is located. Upper mast 130 is also retracted fully. Coiled tubing injector 160 is raised to a vertical position or generally vertical position by tilting the platform 194 of lift mechanism 190. As best shown in the enlarged portion of FIG. 4, brackets 174 are engaged with mounting lugs 124 on support member 116. To accomplish this alignment, the position of beam 168 may be adjusted left or right, up and down, and forward and backward by one or more of cylinder 170A, cylinder 170B, and cylinder 196 of mechanism 190. Though not shown, pins extend through the holes 175 in each pair of brackets 174 and lugs 124 to form a rotating coupling that limits or eliminates lateral movement of injector 160 relative to mast 105. Gooseneck 164 has been unfolded so that it curves upward from injector frame 162 and towards the front of trailer 70. In other instances or other embodiments, lower mast 110 may be partially extended while attaching tubing injector 160 to mast 100, or upper mast 130 may be partially or fully extended during this operation.

Figure 5:
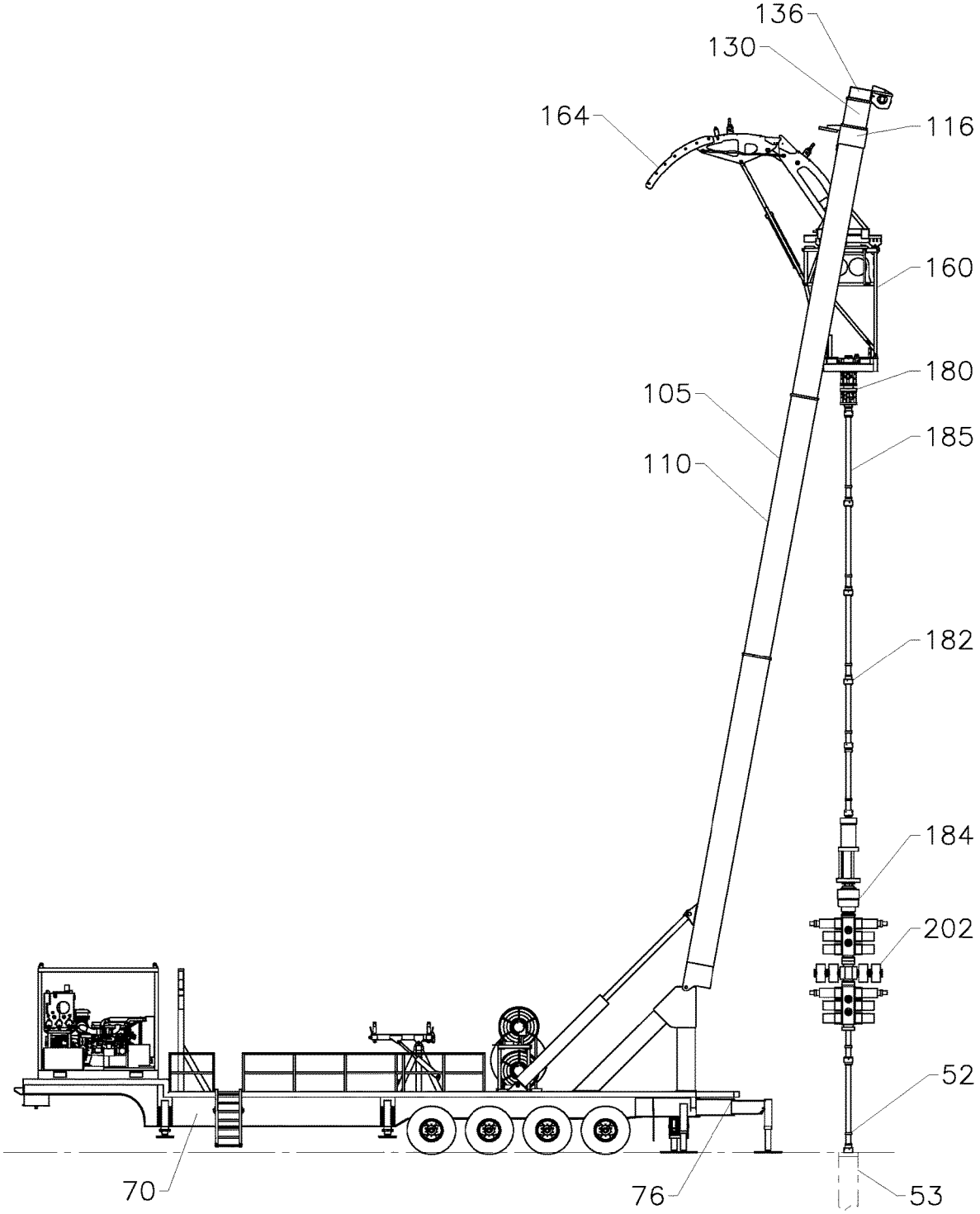
FIG. 5 shows a side view of the mast trailer of FIG. 2 with the lower mast of the twin telescoping mast holding the coiled tubing injector above a wellbore.

Referring now to FIG. 5, mast 105 is shown rotated to a generally vertical position so that the stripper 180 at the bottom of injector 160 is suspended adjacent, possibly over the platform 76 at the rear of trailer 70. Multiple members of lubricator 182 and annular BOP 184 are sequentially coupled threadingly to the stripper 180, forming a lubricator stack 185 extending down from injector 160. The lubricator stack 185 may include additional components. Lower support member 116 is raised by extending the lower mast 110 to accommodate the extra length of each member of lubricator 182 and annular BOP 184 as each is added to lubricator stack 185. In this portion of the work, at least in the example depicted, the upper support member 136 is inactive, passively following the angular and extension movements of the lower support member 116, remaining at a fixed distance from the lower support member 116. The injector, stripper, and lubricator stack 185 remain horizontally-spaced from the wellhead at the end of these steps.

Now, as shown in FIG. 5, after lubricator stack 185 is fully assembled, the lower support member 116 is raised and mast 105 is rotated, as may be needed, to aligned lubricator stack 185 over the top of wellhead 52. This action positions the injector 160 and stack 185 above pressure control equipment 202, which are then coupled together. In the configuration of FIG. 5, injector 160 is ready to feed tubing into or extract tubing from wellbore 53, and the angle 230 of mast 105 is 100 degrees from the horizontal position of FIG. 2.

Up to this point in the disclosure above, the two support members 116, 136 have been described as being used sequentially, to lift and to move multiple oilfield apparatuses one-at-a-time. To reiterate, after grasping, moving and installing pressure control equipment 202, it was released from upper mast 130. Next, the assembly that includes injector 160 was attached, assembled, moved, and installed using lower mast 110. As described below, the twin telescoping masts 110, 130 and their support members 116, 136 can also be used to hold and move multiple oilfield apparatuses simultaneously.

An Example of Using the Twin Telescoping Masts 110, 130 Simultaneously

Figure 6:
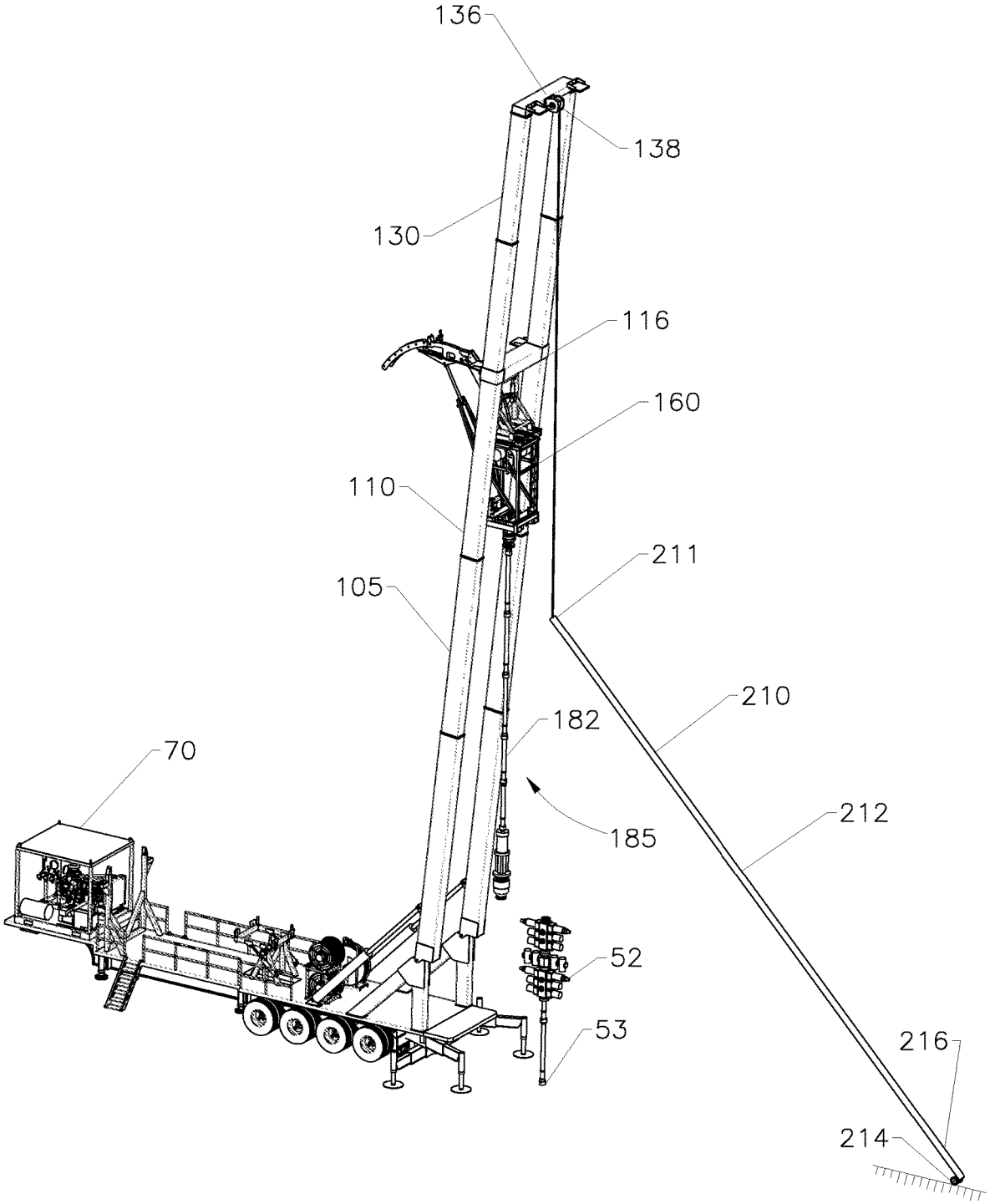
FIG. 6 shows a perspective side view of the mast trailer of FIG. 2 with the lower mast holding the coiled tubing injector adjacent the wellbore and with the upper mast raising or lowering a second piece of equipment.

Referring now to FIG. 6, injector 160 and lubricator stack 185 are attached to lower support member 116. Injector 160 and lubricator stack 185 detached from pressure control equipment 202 and are horizontally displaced from wellhead 52, as may be accomplished by pivoting mast 105 about the rotational coupling of pivot hinge pins 154. The upper mast 130 is extended to raise upper support member 136 in order to lift an additional oilfield apparatus. Cable 140 has been attached to an first end 211 of a tool 210 for deploying a bottom hole assembly (BHA). End 211 is raised from the ground by winch 138. BHA deployment tool 210 includes a tubular sleeve 212, such as a pipe or a series of connected pipe segments, and a wheel 214 located at a second end 216 to roll on the ground. Tool 210 is configured to hold a bottom hole assembly (not visible in FIG. 6) inside the sleeve 212 to be installed or removed from a wellbore. In various embodiments, the BHA includes, for example, a mud motor, a drill bit, jar mechanism, etc. In various embodiments, the BHA is configured for an inspection process.

Figure 7:
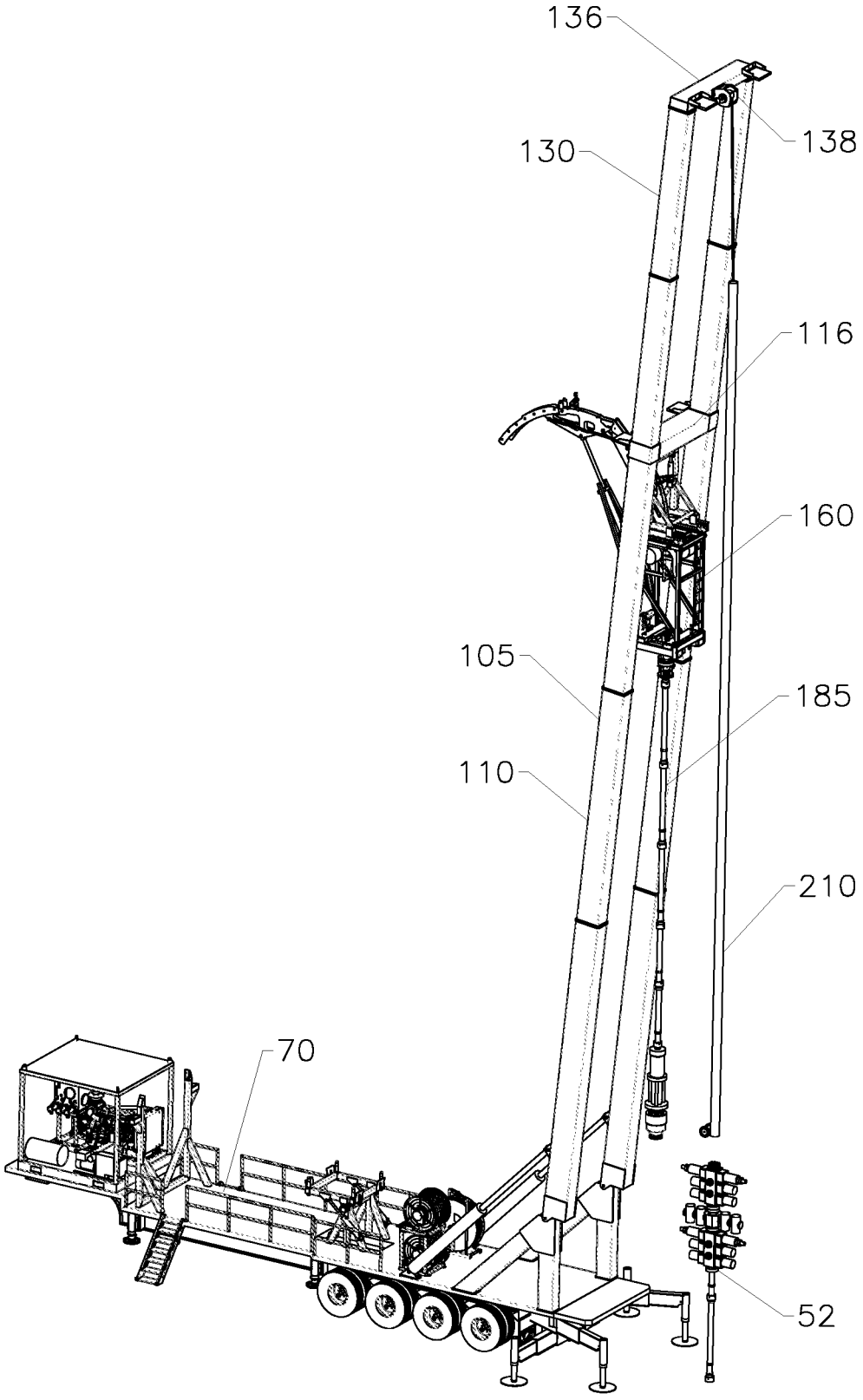
FIG. 7 shows a perspective side view of the mast trailer of FIG. 2 with the twin telescoping mast holding the coiled tubing injector adjacent the wellbore and holding the second piece of equipment over the wellbore.

In FIG. 7, winch 138 has raised tool 210 entirely off the ground and upper mast 130 has position and aligned it over the wellhead 52. At the same time, lower mast 110 has moved or kept the injector 160 and its lubricator stack 185, including stripper 160, closer to the trailer 70 and horizontally spaced-apart from the wellhead 52, waiting for further use that may occur later. The angle of the mast 105 and the difference in heights of the two support members 110, 130 allow tool 210 and injector 160 to be located at two different horizontal positions. Thus, during this operation, twin telescoping mast 105, and support members 116, 136 support multiple oilfield apparatuses simultaneously.

In a next phase of the exemplary operation being described, tool 210 is coupled to the BOP stack of pressure control equipment 202 on wellhead 52, and the internally located BHA is lowered into and held within wellhead 52 to prepare for traveling deeper into well 53. Gripping slips coupled to BOP 204 stack grasp the BHA and support its weight, holding it against any further vertical movement. Subsequently, BHA deployment tool 210 is detached and removed from equipment 202, recreating in a configuration similar to FIG. 7. Tool 210 is lowered by winch 138, guided to the ground, and released. When necessary, the angle of twin mast 105 is adjusted to move tool 210 away from wellhead 52.

With a proper elevation established for lower support member 116, twin mast 105 is tilted to move support member 116 further from trailer 70, repositioning injector 160 and its lubricator stack 185 over and coupling them to wellhead 52, recreating a configuration similar to FIG. 5. In this process, coiled tube 58 is inserted into and coupled with the upper end of the BHA. The completion of this assembly and the subsequent operation is depicted in FIG. 1, and the injector system is then ready to feed tubing into wellbore 53. In some instances, the operation of FIG. 1 includes kick-off drilling using the BHA, taking a new path away from the existing borehole. In other instances, an inspection process or another task is performed, using an appropriately configured BHA.

In the example described, the upper support member 136 has nothing attached to it when injector 160 is coupled to wellhead 52. Optionally, tool 210 may be retained on winch 138 and held at an elevated position, horizontally spaced-apart from wellhead 52 during the operation of FIG. 1. In this optional arrangement, twin telescoping masts 110, 130 and their support members 116, 136 would continue to hold multiple oilfield apparatuses simultaneously.

Additional Information

Referring again to FIG. 4, although the coupling of injector 160 to support member 116 of mast 110 was facilitated by multiple hydraulic cylinders 170 that actuate the lateral and vertical movement of beam 168; other embodiments, include additional or other apparatuses to alight injector mounting assembly 166 with support member 116. For example, some embodiments include additional actuators that move platform 194 of lifting mechanism 190 laterally, front-to-rear, or vertically relative to trailer 70.

As previously descried with respect to FIG. 3, the telescoping lower sections 112, 114 of arms 106, 107 each include three telescoping arm segments, which are segments 112A,B,C; 114A,B,C, respectively. However, in various other embodiments, telescoping lower sections may have fewer or more arm segments configured in accordance with principles described herein. Some of these other telescoping lower sections may include two, four, five, or more arm segments, as examples. Similarly, each telescoping upper sections 132, 134 of arms 106, 107 shown in FIG. 3 includes two telescoping segments, which are 132A,B and 134A,B, respectively. However, in various other embodiments, telescoping upper sections may have fewer or more arm segments configured in accordance with principles described herein. Some of these other telescoping upper sections may include one, two, four, five, or more arm segments, as examples. Although, the arm segments 112A,B,C; 114A,B, C; 132A,B; and 134A,B have been described as having a similar length, in some embodiments, the length of some arm segments differ.

The particular uses of twin telescoping mast 105 described herein are exemplary and are not intended to be limiting.

While exemplary embodiments have been shown and described, modifications thereof can be made by one of ordinary skill in the art without departing from the scope or teachings herein. The embodiments described herein are exemplary only and are not limiting. Many variations, combinations, and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. The inclusion of any particular method step or operation within the written description or a figure does not necessarily mean that the particular step or operation is necessary to the method. The steps or operations of a method listed in the specification or the claims may be performed in any feasible order, except for those particular steps or operations, if any, for which a sequence is expressly stated. In some implementations two or more of the method steps or operations may be performed in parallel, rather than serially.

What is claimed is:

1. A method for hoisting and positioning oilfield apparatus in alignment with a wellbore, comprising:

positioning a moveable support base at a first location at a given distance from the wellbore;

coupling a first oilfield apparatus to a mast having at least two telescoping load bearing arms that are pivotably coupled to the support base, each of the arms comprising a first arm section comprising a first plurality of telescoping arm segments and a second arm section comprising a second plurality of telescoping arm segments that are coaxially aligned with the first plurality of telescoping arm segments, wherein each first plurality of telescoping arm segments is configured to telescope independently of the second plurality of telescoping arm segments with which the first plurality is coaxially aligned, and wherein the first arm section of the first arm is configured to telescope in unison with the first arm section of the second arm, and the second arm section of the first arm is configured to telescope in unison with the second arm section of the second arm;

lifting the first oilfield apparatus through an action of extending the first sections of the at least first and second telescoping arms;

pivoting the at least two telescoping arms to a first position in which the first oilfield apparatus is positioned over the wellbore.

2. The method of claim 1 further comprising:

decoupling the first oilfield apparatus from the mast;

pivoting the mast from the first position to a second position in which the mast is positioned above a second oilfield apparatus;

coupling the second oilfield apparatus to a first support member that is coupled between the first section of each of the first and second arms;

pivoting the mast from the second position to a third position in which the second oilfield apparatus is positioned over the wellbore.

3. The method of claim 2 further comprising:

telescoping the second sections of each of the arms to extend the mast;

coupling a third oilfield apparatus to a second support member that is coupled between the second sections of each of the first and second arms while the second oilfield apparatus remains supported by the mast;

pivoting the mast to a third position in which the third oilfield apparatus is positioned over the wellbore.

4. A method for hoisting and positioning oilfield apparatus in alignment with a wellbore, comprising:

positioning a moveable support base a given distance from the wellbore;

hoisting a first oilfield apparatus from the support base using a mast having at least two telescoping load bearing arms that are pivotably coupled to the support base, each of the arms comprising a first arm section comprising a first plurality of telescoping arm segments and a second arm section comprising a second plurality of telescoping arm segments that are coaxially aligned with the first plurality of telescoping arm segments, wherein each first plurality of telescoping arm segments is configured to telescope independently of the second plurality of telescoping arm segments with which it is coaxially aligned, and wherein the first arm section of the first arm is configured to telescope in unison with the first arm section of the second arm, and the second arm section of the first arm is configured to telescope in unison with the second arm section of the second arm;

wherein the hoisting is accomplished through an action of extending at least the first sections of the first and second telescoping arms; and pivoting the at least two telescoping arms to a first position while supporting the first oilfield apparatus.

5. The method of claim 4 wherein hoisting the first oilfield apparatus comprises coupling the first oilfield apparatus to a first support member that is coupled between the first sections of each of the first and second arms; and wherein pivoting the arms to a first position comprises pivoting the arms from a position short of vertical to the first position that is past vertical.

6. The method of claim 5 further comprising:

telescoping at least the second sections of each of the arms to extend the mast while the first oilfield apparatus remains supported by the mast;

pivoting the mast to a second position while the first oilfield apparatus remains supported by the mast;

coupling a second oilfield apparatus to a second support member that is coupled between the second sections of each of the first and second arms while the first oilfield apparatus remains supported by the mast; and pivoting the mast to a third position in which the second oilfield apparatus is positioned over the wellbore.

7. The method of claim 6 further comprising telescoping the first sections of each of the arms to extend the mast prior to telescoping the second sections of each of the arms to extend the mast.

8. An apparatus for hoisting oilfield apparatus to a position aligned with a wellbore, the apparatus comprising:

a support base configured for movement along the earth's surface;

a mast assembly comprising at least two telescoping load bearing arms pivotably coupled to the support base and configured to pivot in unison with each other relative to the support base, each of the two telescoping arms comprising a first arm section comprising a first plurality of telescoping arm segments and a second arm section comprising a second plurality of telescoping arm segments that are coaxially aligned with the first plurality of telescoping arm segments;

wherein the first arm section of the first arm is configured to telescope selectively to a longer or a shorter length in unison with the first arm section of the second arm, and the second arm section of the first arm is configured to telescope selectively to a longer or a shorter length in unison with the second arm section of the second arm;

wherein each first plurality of telescoping arm segments is configured to telescope independently of the second plurality of telescoping arm segments with which the first plurality is coaxially aligned; and a first support member coupled to the first arm sections of the first and second telescoping arm; and a second support member coupled to the second arm sections of the first and second telescoping arm.

9. The apparatus of claim 8 further comprising a mechanism coupled between the mast assembly and the support base for pivoting the telescoping load bearing arms.

10. The apparatus of claim 9 wherein the mechanism for pivoting the telescoping load bearing arms is configured to pivot the arms from a first position in which the arms are parallel with the support base to a second position in which the arms are rotated to a position that is at least 90 degrees from the first position.

11. The apparatus of claim 10 wherein in the second position, the load bearing arms form an acute angle with respect to the axis of the wellbore of between 0 and 10 degrees.

12. The apparatus of claim 10 further comprising:

a hydraulic power supply mounted on the support base;

a first hinge coupling the first arm to the frame structure at a distance D above the support base;

a second hinge coupling the second arm to the frame structure at a distance D above the support base; and a coiled tubing injector unit mounted on a lift, the lift being positioned on the support base between the arms and at a distance from the first and second hinges that is less than the distance between the hinges to the first support member when the arms are in the first position.

13. The apparatus of claim 9 wherein the mechanism for pivoting the arms comprises:

a frame structure coupled to the support base;

a first hinge coupling the first arm to the frame structure at a distance D above the support base;

a second hinge coupling the second arm to the frame structure at a distance D above the support base; and a plurality of hydraulic cylinders coupled to the support base and configured to pivot the arms from the first to the second position.

14. The apparatus of claim 8 wherein the first support member is a first cross member extending between and coupled to the innermost coaxially-aligned segments of the first sections of each of the arms, and wherein the first cross member includes at least a pair of connections configured to couple rotatably the first oilfield apparatus to the first cross member, the connections configured to allow the first oilfield apparatus to rotate between the two arms as the mast is pivoted from the first to the second position.

15. The apparatus of claim 8 wherein the second support member comprises a second cross member extending between and coupled to the innermost coaxially-aligned segments of the second sections of each of the arms, and further comprises a lifting device coupled to the second cross member.

16. The apparatus of claim 15 wherein the lifting device comprises a winch.

* * * * *